US006829449B2

(12) United States Patent
Matsumoto et al.

(10) Patent No.: US 6,829,449 B2
(45) Date of Patent: Dec. 7, 2004

(54) IMAGE FORMING APPARATUS WITH TRANSFER BIAS INVERTING FUNCTION

(75) Inventors: Hiroyoshi Matsumoto, Ibaraki (JP); Teruaki Mitsuya, Ibaraki (JP); Tsuneaki Kawanishi, Ibaraki (JP); Hisao Okada, Ibaraki (JP); Natsuki Kuribayashi, Ibaraki (JP); Masayoshi Ishii, Ibaraki (JP); Keisuke Kubota, Ibaraki (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 0 days.

(21) Appl. No.: 10/448,292

(22) Filed: May 30, 2003

(65) Prior Publication Data

US 2004/0052541 A1 Mar. 18, 2004

(30) Foreign Application Priority Data

Sep. 17, 2002 (JP) ..... P2002-270288

(51) Int. Cl.[7] ..... G03G 15/16
(52) U.S. Cl. ..... 399/66; 399/313
(58) Field of Search ..... 399/66, 297–301, 399/313–314

(56) References Cited

U.S. PATENT DOCUMENTS 6,516,179 B1 * 2/2003 Sawai et al.

FOREIGN PATENT DOCUMENTS

| | | |
|---|---|---|
| JP | 51-9840 | 1/1976 |
| JP | 61-32667 | 2/1986 |
| JP | 2-176779 | 7/1990 |
| JP | 3-069978 | 3/1991 |
| JP | 10-026888 | 10/1998 |
| JP | 2000-181322 | 6/2000 |

* cited by examiner

*Primary Examiner*—Arthur T. Grimley
*Assistant Examiner*—Ryan Gleitz
(74) *Attorney, Agent, or Firm*—McGinn & Gibb, PLLC

(57) ABSTRACT

A transfer member transporting section is disposed so as to bring a tip end of a transfer member into contact with a peripheral face of a transfer rotary member before the tip end of the transfer member enters a nip area. A bias power supply has a polarity inverting function of, during a period from a timing when the tip end of the transfer member is brought into contact with the transfer rotary member by the transfer member transporting section, to that when the tip end of the transfer member enters the nip area, applying a voltage of a polarity which is identical with that of a toner, to the transfer rotary member, and after the tip end of the transfer member enters the nip area, applying a voltage of a polarity which is opposite to that of the toner, to the transfer rotary member.

2 Claims, 2 Drawing Sheets

IMAGE FORMING APPARATUS WITH TRANSFER BIAS INVERTING FUNCTION

BACKGROUND OF THE INVENTION

1. Field of the Invention

The present invention relates to an electrophotographic image forming apparatus in which an image is developed by using a toner or like colored particles, such as an electrostatic copier, a printer, or a facsimile apparatus, and more particularly to a transfer section of such an apparatus.

2. Description of the Related Art

In an electrophotographic image forming apparatus, a latent image is formed in the surface of an image carrier by using a laser beam, and the image is then developed by supplying a toner from a development roll. The development system is roughly classified as either the normal development system or the reversal development system according to the charge polarity of the surface of the image carrier and that of the toner. As a result of the development process, the toner is electrostatically attracted to the surface of the image carrier to form a toner image, and a voltage of a polarity which is opposite to the charge polarity of the toner is applied by a transfer charging device of, for example, the roller transfer system using a transfer roller which butts against the image carrier, or the corona transfer system, so that the toner image is transferred to a transfer member.

During the process of transferring the toner image which is formed by the development process, to the transfer member, when the transfer member enters between the image carrier and the transfer charging device, the toner tends to be scattered. It is usually recognized that the transfer efficiency of the corona transfer system is lower than that of the roller transfer system. For the corona transfer system, therefore, a method in which a voltage is applied to a sheet transport guide or the like before the transfer process has been proposed in, for example, JP-A-61-32667, JP-A-10-26888 and JP-A-2000-181322.

For the roller transfer system, a method in which a transfer member is once brought into contact with an image carrier to prevent a toner image from being scattered has been proposed in, for example, JP-A-2-176779. Another method in which a voltage of a polarity that is identical with that, of a toner, i.e., that is opposite to that of the transfer process is applied to a zone where a transfer member does not exist, thereby preventing the toner from adhering to a transfer roller has been proposed in, for example, JP-A-51-9840 and JP-A-3-69978.

In the method in which a voltage is applied to a sheet transport guide or the like before the transfer process in the corona transfer system, a structure for electrically insulating the sheet transport guide from other parts surrounding the guide, and electronic components for controlling the voltage applied to the sheet transport guide must be additionally disposed, and the image forming apparatus itself must be complicatedly configured.

In the method in which a transfer member is brought into contact with an image carrier to prevent a toner attracted to the image carrier from being scattered in the roller transfer system, the transfer member is in contact with the image carrier in a zone previous to the transfer process. Therefore, end faces of the transfer member are smeared with a toner which is electrostatically attracted to, for example, a background area of the image carrier, whereby the print quality is extremely lowered. The method has further various problems such as that, depending on the angle of a contact between the transfer member and the image carrier, or the thickness of the transfer member, the photosensitive surface of the image carrier may be damaged at the contact, and that noise is generated at the contact.

SUMMARY OF THE INVENTION

It is an object of the invention to provide an image forming apparatus which is free from the defects of the conventional art, and in which a satisfactory image can be obtained by a simple configuration.

In order to attain the object, the invention is directed to an image forming apparatus comprising: an image carrier which carries a toner image, such as a photosensitive drum; a transfer rotary member which transfers the toner image from the image carrier to a sheet or a like transfer member, such as a transfer roller; a bias power supply which applies a voltage to the transfer rotary member; and a transfer member transporting section, such as a transport roller or a transport guide which transports and guides the transfer member toward a nip area that is formed by the image carrier and the transfer rotary member.

The invention is characterized in that the transfer member transporting section is disposed to bring a tip end of the transfer member into contact with a peripheral face of the transfer rotary member before the tip end of the transfer member enters the nip area, and the bias power supply has a polarity inverting function of: during a period from a timing when the tip end of the transfer member is brought into contact with the transfer rotary member by the transfer member transporting section, to a timing when the tip end of the transfer member enters the nip area, applying a voltage of a polarity which is identical with a polarity of a toner, to the transfer rotary member; and, after the tip end of the transfer member enters the nip area, applying a voltage of a polarity which is opposite to the polarity of the toner, to the transfer rotary member.

The invention is characterized in that, in the above configuration, an elastic layer such as a sponge layer or a layer of electrically conductive rubber is formed in an outer peripheral portion of the transfer rotary member.

According to the thus configured apparatus of the invention, smearing of the transfer member caused by contact between the image carrier and the transfer roller can be prevented from occurring, and a high-quality image can be obtained.

DETAILED DESCRIPTION OF THE PREFERRED EMBODIMENTS

Now, a description will be given in more detail of preferred embodiments of the invention with reference to the accompanying drawings.

Figure 1:
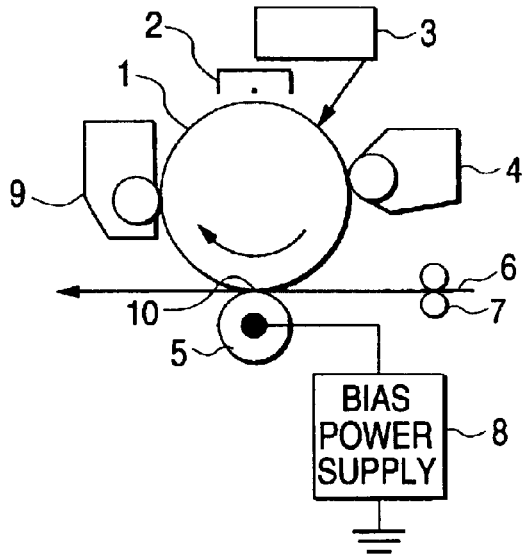
FIG. 1 is a diagram specifically showing the configuration of a laser printer which is an embodiment of the invention.

FIG. 1 is a diagram specifically showing the configuration of a laser printer which is an embodiment of the invention.

In the embodiment, a drum-like organic photoconductor (hereinafter, referred to as photosensitive drum 1) is used as an image carrier which is shown in a center portion of the figure.

The photosensitive drum 1 is rotated in a clockwise direction, and the surface of the drum is uniformly charged by a charging device 2. In the embodiment, the drum surface is negatively charged. In the charged photosensitive drum 1, an electrostatic latent image is formed by an exposing device 3. In the photosensitive drum 1 having the electrostatic latent image, a toner image is formed by a developing device 4. In the embodiment, a two-component developing system using a negatively-charged toner and a carrier is employed. In a developing step, an image is developed in a portion which has been exposed by the exposing device 3, and in which surface charges are extinguished. The toner image is sent to a transfer station while being attracted to the photosensitive drum 1.

Figure 2:
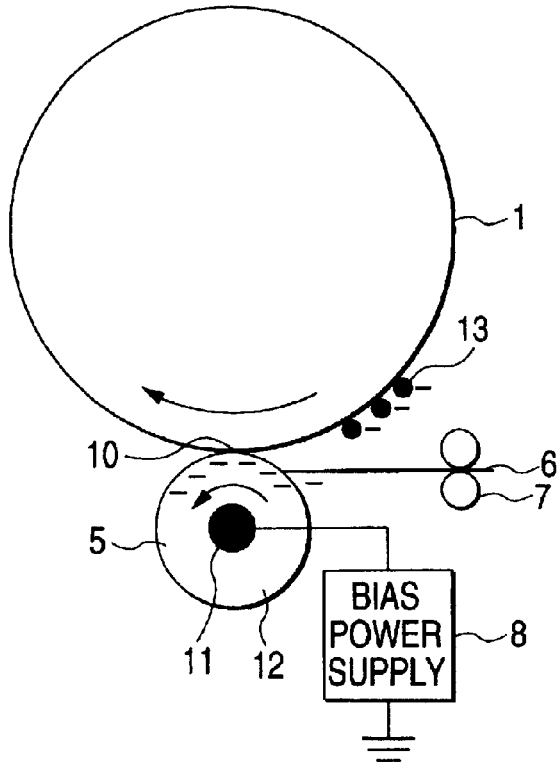
FIG. 2 is an enlarged view of the vicinity of a transfer station of the laser printer and showing a state where a tip end portion of a sheet is in contact with a transfer roller.
Figure 3:
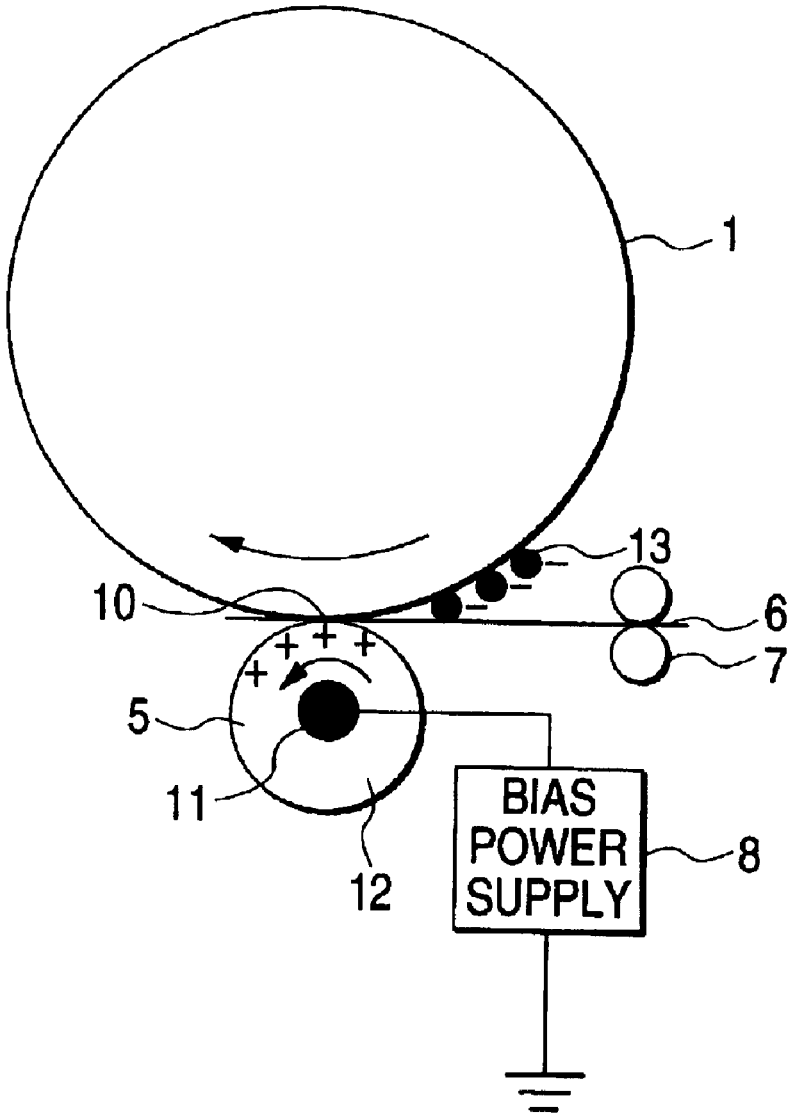
FIG. 3 is an enlarged view of the vicinity of the transfer station of the laser printer and showing a state where the tip end portion of the sheet enters a nip area between a photosensitive drum and the transfer roller.

FIGS. 2 and 3 are expanded views of the vicinity of the transfer station. FIG. 2 shows a state where the tip end portion of a sheet 6 is in contact with a transfer roller 5, and FIG. 3 shows a state where the tip end portion of the sheet 6 enters a nip area 10 between the photosensitive drum 1 and the transfer roller 5.

The sheet 6 which has not yet been subjected to the transfer process is supplied by a transport roller 7 in timing with the rotation speed of the photosensitive drum 1. The transfer roller 5 is made of foamed rubber (sponge), and driven with rotation of the photosensitive drum 1. A bias voltage is applied to the transfer roller by a bias power supply 8.

As shown in FIG. 2, the tip end portion of the sheet 6 which is supplied by the transport roller 7 is first in contact with the peripheral face of the transfer roller 5. In order to enable the tip end portion of the sheet 6 to be surely in contact with the peripheral face of the transfer roller 5, the levels of the transport roller 7 and a sheet transport guide (not shown) are set to be slightly lower (on the side of the transport roller 7) than the level of the nip area 10 between the photosensitive drum 1 and the transfer roller 5.

In the embodiment, in order to cushion the impact and prevent noise from being generated when the sheet 6 is brought into contact with the transfer roller 5, a sponge layer 12 is formed around the outer periphery of the core 11 of the transfer roller 5. The invention is not restricted to this, and the transfer roller may be configured by a metal roller, or a roller in which a layer of electrically conductive rubber is formed around the outer periphery of a metal roller.

The bias power supply 8 has a polarity inverting function of: during a non-sheet pass period which exists before and after the entering of the sheet 6 into the nip area 10, as shown in FIG. 2, a negative voltage, i.e., a voltage which is identical in polarity with a toner 13 is applied; and, during a period when the sheet 6 is in the nip area 10, as shown in FIG. 3, a positive voltage, i.e., a voltage which is opposite in polarity to the toner 13 is applied.

When the sheet 6 is in contact with the transfer roller 5, the negative voltage applied to the transfer roller charges the sheet 6 to the same polarity as that of the toner 13. Therefore, the toner image which is electrostatically attracted to the photosensitive drum 1 can be prevented from being scattered by an abnormal discharge which may occur between the toner 13 and the sheet 6 before the transfer process, so that a high-quality image can be obtained.

The toner which is not transferred to the sheet 6 and remains on the photosensitive drum 1 is recovered by a cleaning device 9 shown in FIG. 1. The photosensitive drum 1 which has been cleaned by the cleaning device 9 is again advanced to the charging device 2 to be used in the next image forming process.

As described above, the tip end of a transfer member is in contact with a transfer rotary member, before the tip end of the transfer member enters a nip area formed by the transfer rotary member and an image carrier which transports a toner image formed by a developing station. Therefore, a toner can be prevented from being scattered, and a high-quality image can be obtained without newly adding components for applying and controlling a voltage, complicating the structure of the apparatus, and causing smearing of the transfer member due to contact between the image carrier and the transfer member.

In the embodiment described above, the invention is applied to an image forming apparatus of the reversal development system. Also in the case where the invention is applied to an apparatus of the normal development system, the effects can be similarly achieved.

In the embodiment, a transfer roller is used as the transfer rotary member. Alternatively, the invention can be applied also to an image forming apparatus in which a transfer belt is used. When an elastic layer such as a sponge layer or a layer of electrically conductive rubber is formed in an outer peripheral portion of the transfer rotary member, a shock and noise are generated at a lower degree even when a tip end of the transfer member is brought into contact with the outer peripheral portion of the transfer rotary member.

What is claimed is:

1. An image forming apparatus comprising:

an image carrier which carries a toner image;

a transfer rotary member which transfers the toner image from said image carrier to a transfer member;

a bias power supply which applies a voltage to said transfer rotary member; and a transfer member transporting section which transports and guides said transfer member toward a nip area that is formed by said image carrier and said transfer rotary member, wherein said transfer member transporting section is disposed to bring a tip end of said transfer member into contact with a peripheral face of said transfer rotary member before said tip end of said transfer member enters said nip area, and wherein said bias power supply has a polarity inverting function of, during a period from a timing when said tip end of said transfer member is brought into contact with said transfer rotary member by said transfer member transporting section, to a timing when said tip end of said transfer member enters said nip area, applying a voltage of a polarity which is identical with a polarity of a toner, to said transfer rotary member; and, after said tip end of said transfer member enters said nip area, applying a voltage of a polarity which is opposite to the polarity of the toner, to said transfer rotary member.

2. The image forming apparatus according to claim 1, wherein an elastic layer is formed in an outer peripheral portion of said transfer rotary member.

* * * * *